US008496569B2

(12) United States Patent
Balletti et al.

(10) Patent No.: US 8,496,569 B2
(45) Date of Patent: Jul. 30, 2013

(54) MANUFACTURING MACHINE FOR PRODUCING COMBINATION CIGARETTE FILTERS

(75) Inventors: Leonardo Balletti, San Lazzaro di Savena (IT); Marco Esposti, Casalecchio di Reno (IT)

(73) Assignee: G.D Societa' per Azioni, Bologna (IT)

( * ) Notice: Subject to any disclaimer, the term of this patent is extended or adjusted under 35 U.S.C. 154(b) by 829 days.

(21) Appl. No.: 12/505,197

(22) Filed: Jul. 17, 2009

(65) Prior Publication Data

US 2010/0012133 A1 Jan. 21, 2010

(30) Foreign Application Priority Data

Jul. 18, 2008 (IT) ..... BO2008A0455

(51) Int. Cl.
*B31C 99/00* (2009.01)

(52) U.S. Cl.
USPC ..... 493/39; 493/42

(58) Field of Classification Search
USPC ..... 493/39, 42, 45, 46, 47, 50
See application file for complete search history.

(56) References Cited

U.S. PATENT DOCUMENTS 3,308,832 A * 3/1967 Stelzer et al. ..... 131/94
4,032,133 A * 6/1977 Steffens et al. ..... 493/421
4,301,816 A * 11/1981 Wahle et al. ..... 131/88
4,506,779 A * 3/1985 Seragnoli ..... 198/459.1
4,648,858 A * 3/1987 Lewis et al. ..... 493/4
5,558,103 A * 9/1996 Garthaffner et al. ..... 131/94
5,887,595 A * 3/1999 Draghetti et al. ..... 131/29
6,202,650 B1 * 3/2001 Kaneki et al. ..... 131/360
6,336,896 B1 * 1/2002 Hsu et al. ..... 493/39
6,475,129 B1 * 11/2002 Lehmann ..... 493/421
6,701,934 B2 * 3/2004 Schlisio et al. ..... 131/94
7,226,404 B2 * 6/2007 Rizzoli et al. ..... 493/48

(Continued)

FOREIGN PATENT DOCUMENTS

DE 102007049547 A1 4/2008
EP 1504680 A1 2/2005

(Continued)

OTHER PUBLICATIONS

European Search Report in EP 09 16 5849 dated Jan. 25, 2010.
European Search Report in EP 09 16 5849 dated Oct. 23, 2009.

*Primary Examiner* — M. Alexandria Elve
*Assistant Examiner* — Eyamindae Jallow
(74) *Attorney, Agent, or Firm* — Marshall Gerstein & Borun LLP

(57) ABSTRACT

A manufacturing machine includes a group-forming unit for forming filter portion groups, each group having at least two different filter portions aligned axially and contacting at the ends; a winding unit that receives a succession of groups from the group-forming unit, winds a strip of wrapping material about the groups to form a continuous filter rod, and cuts combination filters off the rod by cyclically cutting the rod transversely; and a transfer unit that transfers the groups from the group-forming unit, in which the groups travel transversely, to the winding unit, in which the groups travel axially. The transfer unit has at least one spider that feeds the groups successively into a forming beam of the winding unit, and at least one release drum that releases the groups successively to the spider. The release drum is mounted to move between a work position and a maintenance position.

16 Claims, 3 Drawing Sheets

U.S. PATENT DOCUMENTS

| | | | | |
|---|---|---|---|---|
| 7,547,271 | B2 * | 6/2009 | Kato | 493/42 |
| 7,578,777 | B2 * | 8/2009 | Draghetti et al. | 493/39 |
| 7,922,638 | B2 * | 4/2011 | Draghetti et al. | 493/39 |
| 8,118,721 | B2 * | 2/2012 | Cieslikowski et al. | 493/39 |
| 8,172,739 | B2 * | 5/2012 | Horn et al. | 493/39 |
| 2002/0174873 | A1 * | 11/2002 | Schlisio et al. | 131/282 |
| 2004/0237972 | A1 * | 12/2004 | Horn et al. | 131/88 |

FOREIGN PATENT DOCUMENTS

| | | | |
|---|---|---|---|
| EP | 1518468 | A2 | 3/2005 |
| EP | 1 532 879 | A1 | 5/2005 |
| EP | 1561386 | A1 | 8/2005 |
| EP | 1 787 534 | A1 | 5/2007 |
| EP | 1 913 825 | A1 | 4/2008 |

* cited by examiner

MANUFACTURING MACHINE FOR PRODUCING COMBINATION CIGARETTE FILTERS

CROSS-REFERENCE TO RELATED APPLICATIONS

This application claims the benefit of Italian patent application No. BO 2008A 000455, filed Jul. 18, 2008.

TECHNICAL FIELD

The present invention relates to a manufacturing machine for producing combination cigarette filters.

BACKGROUND ART

A manufacturing machine for producing combination cigarette filters comprises a group-forming unit that forms groups of filter portions, each comprising at least two different filter portions aligned axially and contacting at the ends; a winding unit which receives a succession of groups of filter portions from the group-forming unit, winds a strip of wrapping material about the succession of groups of filter portions to form a continuous filter rod, and cuts combination filters from the continuous filter rod by cyclically cutting the continuous filter rod transversely; and a transfer unit which transfers the groups of filter portions from the group-forming unit, in which the groups of filter portions travel transversely (i.e. perpendicular to their central axes), to the winding unit, in which the groups of filter portions travel axially (i.e. parallel to their central axes). Because it receives the groups of filter portions travelling transversely, and releases them travelling longitudinally, the transfer unit must therefore alter the travelling mode of the groups of filter portions.

Known transfer units normally comprise a drum having a number of horizontal suction seats rotated, parallel to themselves, about a central axis of rotation. The drum, known as and hereinafter referred to as a "spider", feeds the groups of filter portions successively into a forming beam of the winding unit.

Known transfer units also comprise at least one release drum for releasing the groups of filter portions successively to the spider. One example of a transfer unit of the above type is described in Patent Application EP1787534A1.

To meet changing market demand, a modern manufacturing machine must be able to produce a range of combination cigarette filters, which means brand changes are relatively frequent to change the machine over to the manufacture of a different type of combination cigarette filter. Very often, the new combination cigarette filter to be produced on the manufacturing machine differs in length from the previously produced type, thus resulting in a difference in the length of the groups of filter portions, and inevitably in necessary alterations to the transfer unit. In particular, a brand change may call for adjusting/changing mechanical parts (e.g. the cams or suction seats) of the spider and/or of the release drum. On known manufacturing machines, however, adjusting/changing mechanical parts of the spider and particularly of the release drum is extremely complicated and time-consuming, on account of meshing of the spider seats and release drum seats seriously limiting access to the spider and particularly to the release drum.

DISCLOSURE OF THE INVENTION

It is an object of the present invention to provide a manufacturing machine for producing combination cigarette filters, designed to eliminate the above drawbacks and which is also cheap and easy to produce.

According to the present invention, there is provided a manufacturing machine for producing combination cigarette filters, as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
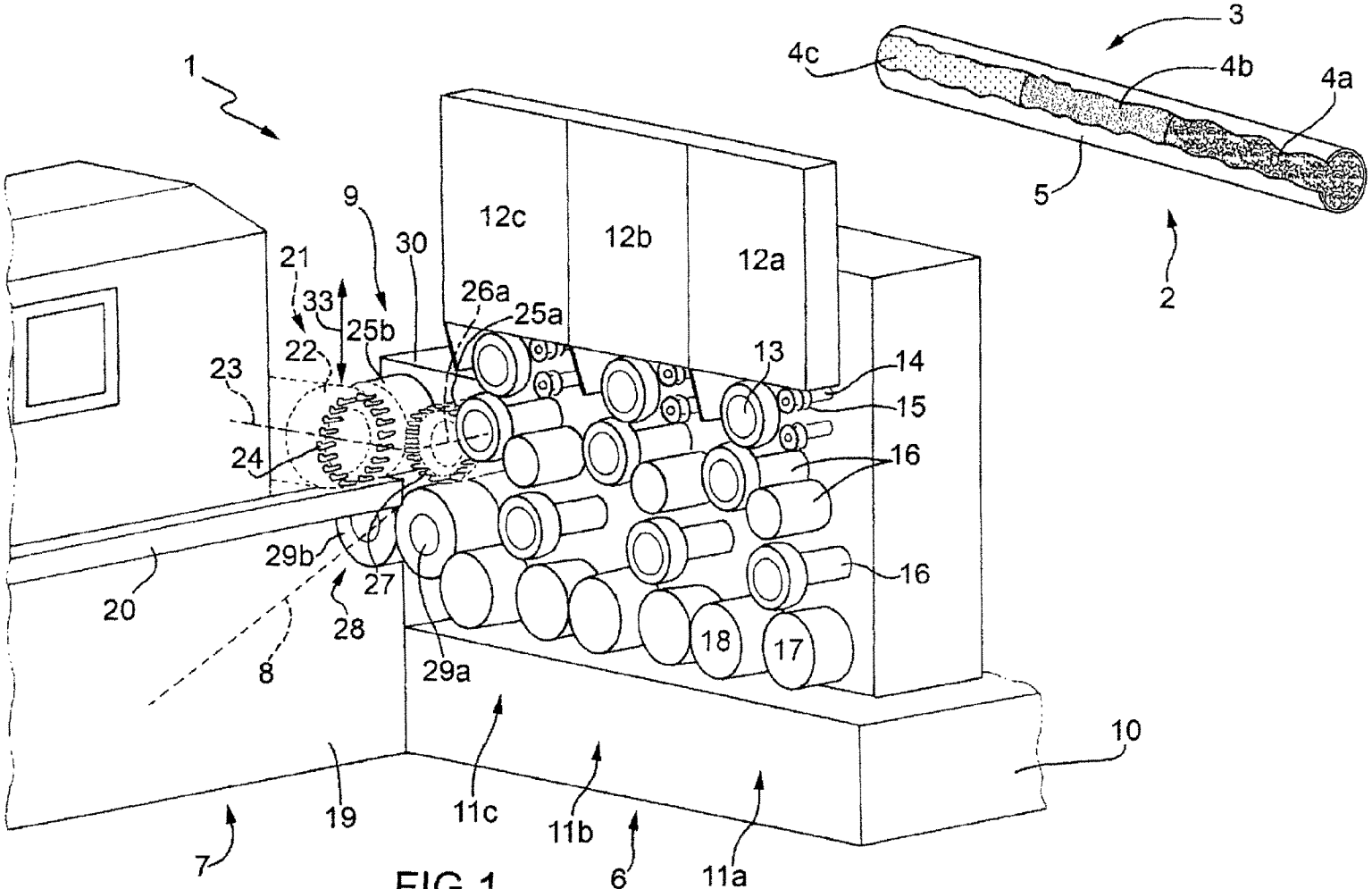
FIG. 1 shows a schematic view in perspective, with parts removed for clarity, of a manufacturing machine for producing combination cigarette filters, in accordance with the present invention.

Number 1 in FIG. 1 indicates as a whole a manufacturing machine for producing combination cigarette filters 2, each of which comprises a group 3 of filter portions 4 wrapped in a sheet 5 of wrapping material folded and glued into a tube.

Manufacturing machine 1 comprises a group-forming unit 6 for forming groups 3 of filter portions 4, each comprising three different filter portions 4 aligned axially and contacting at the ends. Manufacturing machine 1 also comprises a winding unit 7, which receives a succession of groups 3 of filter portions 4 from group-forming unit 6, winds a strip 8 of wrapping material about the succession of groups 3 of filter portions 4 to form a continuous filter rod (not shown), and cuts individual combination filters 2 from the continuous filter rod by cyclically cutting the continuous filter rod transversely. Finally, manufacturing machine 1 comprises a transfer unit 9, which transfers groups 3 of filter portions 4 from group-forming unit 6, in which groups 3 of filter portions 4 travel transversely (i.e. perpendicular to their central axes), to winding unit 7, in which groups 3 of filter portions 4 travel axially (i.e. parallel to their central axes).

Group-forming unit 6 comprises a frame 10 that rests on the floor and supports three structurally identical feed stations 11, each for supplying respective filter portions 4 to form groups 3 of filter portions 4. Each feed station 11 comprises a top hopper 12 housing a mass of respective filter portions 4 of a length that is a multiple of the final length; a withdraw drum 13 that withdraws filter portions 4 successively from the bottom of hopper 12, and cooperates with two cutting drums 14 fitted with respective circular blades 15 to cut filter portions 4 transversely to the desired length; a set of three aligning drums 16, which receive and correctly align the cut filter portions 4 from withdraw drum 13; an insertion drum 17, which receives groups 3 of filter portions 4 from a preceding feed station 11 or, in the case of the first feed station 11, forms groups 3 of filter portions 4, and inserts the filter portions 4 received from an end aligning drum 16 into respective groups 3 of filter portions 4; and, finally, an output drum 18, which receives groups 3 of filter portions 4 from insertion drum 17, and transfers groups 3 of filter portions 4 to the next feed station 11 or, in the case of the last feed station 11, to transfer unit 9.

Winding unit 7 is a two-line type, and comprises a frame 19 resting on the floor and supporting a horizontal forming beam 20 having two parallel grooves, inside each of which a respective strip 8 of wrapping material is wound about a continuous succession of groups 3 of filter portions 4 contacting end to end and travelling in a direction parallel to their longitudinal axes, to form a continuous filter rod (not shown).

Transfer unit 9 is of the type described in Patent Application EP1787534A1, which is included herein by way of reference, and to which the reader is referred for a more detailed description of the structure and operation of transfer unit 9.

Transfer unit 9 is fitted to frame 10 of group-forming unit 6, and comprises a spider 21 defined by a drum 22 that rotates continuously about a horizontal axis of rotation 23 and supports a number of peripheral assemblies 24, each of which is fitted to drum 22 to rotate, as drum 22 rotates, about a respective axis of rotation parallel to axis of rotation 23 of drum 22, so as to remain horizontal and parallel to itself at all times. Each assembly 24 supports a suction gripping head having two parallel suction seats, which remove two groups 3 of filter portions 4 simultaneously from two release drums 25*a* and 25*b*. That is, the two suction seats of each suction gripping head of spider 21 simultaneously receive a group 3 of filter portions 4 from release drum 25*a*, and another group 3 of filter portions 4 from release drum 25*b*.

The two release drums 25 of unit 9 are arranged side by side and parallel, and are mounted to rotate about respective parallel horizontal axes of rotation 26 perpendicular to axis of rotation 23 of drum 22. Each release drum 25 has radial arms 27 mounted to rotate about axes of rotation parallel to axis of rotation 26 of release drum 25, and having respective suction seats on the end for housing groups 3 of filter portions 4.

Finally, transfer unit 9 comprises a divider 28 that divides a single stream of groups 3 of filter portions 4 from group-forming unit 6 into two symmetrical streams of groups 3 of filter portions 4, which are fed to the two release drums 25, which in turn transfer the respective groups 3 of filter portions 4 to spider 21. Divider 28 comprises a dividing drum 29*a* that receives a single stream of filter portions 4 from group-forming unit 6 and feeds a first stream of filter portions 4 to release drum 25*a* located over dividing drum 29*a*. Divider 28 also comprises a dividing drum 29*b* that receives a second stream of filter portions 4 from dividing drum 29*a* and feeds the stream of filter portions 4 to release drum 25*b* located over dividing drum 29*b*.

Figure 2:
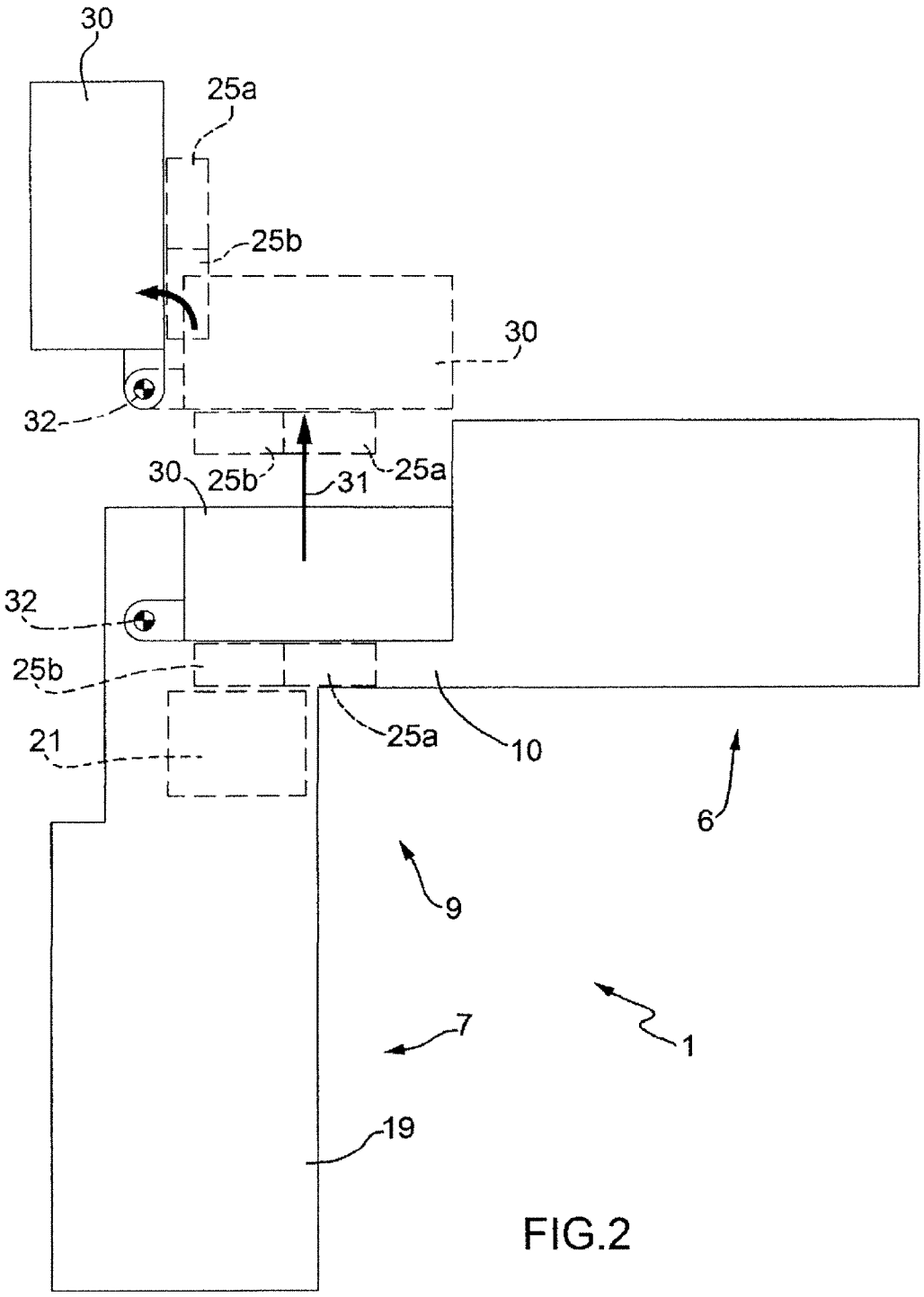
FIG. 2 shows a plan view of the FIG. 1 manufacturing machine, with a portion of a transfer unit in a maintenance position.

In a preferred embodiment shown in FIG. 2, spider 21 is fitted in a fixed position to frame 10 of group-forming unit 6, whereas the two release drums 25 and the two dividing drums 29 of divider 28 are fitted to a movable frame 30 fitted movably to frame 10 of group-forming unit 6. More specifically, movable frame 30 supporting the two release drums 25 and the two dividing drums 29 of divider 28 is mounted to move, with respect to frame 10 of group-forming unit 6 and with respect to frame 19 of winding unit 7 (and hence with respect to spider 21), between a work position (shown in FIG. 1 and by the continuous line in FIG. 2), in which release drums 25 are adjacent and connected to spider 21, and a maintenance position (shown by the continuous line in FIG. 2), in which release drums 25 are detached a good distance from spider 21.

In a preferred embodiment, movable frame 30 is mounted to slide, in a horizontal travel direction 31 parallel to axes of rotation 26 of release drums 25, between the work position (shown in FIG. 1 and by the continuous line in FIG. 2) and an intermediate position (shown by the dash line in FIG. 2), and is mounted to rotate, about a vertical axis of rotation 32 crosswise to travel direction 31, between the intermediate position (shown by the dash line in FIG. 2) and the maintenance position (shown by the continuous line in FIG. 2). For the sake of clarity (i.e. to avoid overlapping in FIG. 2), the travel in direction 31 into the intermediate position is exaggerated in FIG. 2, and in actual fact serves simply to disengage release drums 25 from spider 21 to permit rotation about axis of rotation 32 into the maintenance position with no mechanical interference.

By way of example, a support of movable frame 30 may be hinged to a slide to rotate with respect to the slide about axis of rotation 32; and the slide in turn is mounted on runners integral with frame 10, to slide in travel direction 31 with respect to frame 10.

In a preferred embodiment shown in FIG. 1, spider 21 is fitted movably to frame 19 of winding unit 7 to move in a vertical travel direction 33 perpendicular to axis of rotation 23 of drum 22 of spider 21, to adjust the distance between axis of rotation 23 of drum 22 of spider 21 and forming beam 20 of winding unit 7 as a function of the size of groups 3 of filter portions 4. In other words, a change in the size of groups 3 of filter portions 4 may call for changing part of drum 22, thus altering the diameter of drum 22. Which means the distance between axis of rotation 23 of drum 22 of spider 21 and forming beam 20 must be adjusted. Movable frame 30 supporting the two release drums 25 and the two dividing drums 29 of divider 28 is also fitted movably to frame 10 of group-forming unit 6, to move in a vertical travel direction 33 together with spider 21. In other words, when spider 21 is moved a given amount in vertical travel direction 33, the two release drums 25 connected to spider 21 must also be moved by the same amount in vertical travel direction 33. Obviously, the two dividing drums 29 of divider 28 must also be moved in vertical travel direction 33 to accompany the two release drums 25 to which they supply groups 3 of filter portions 4.

Figure 3:
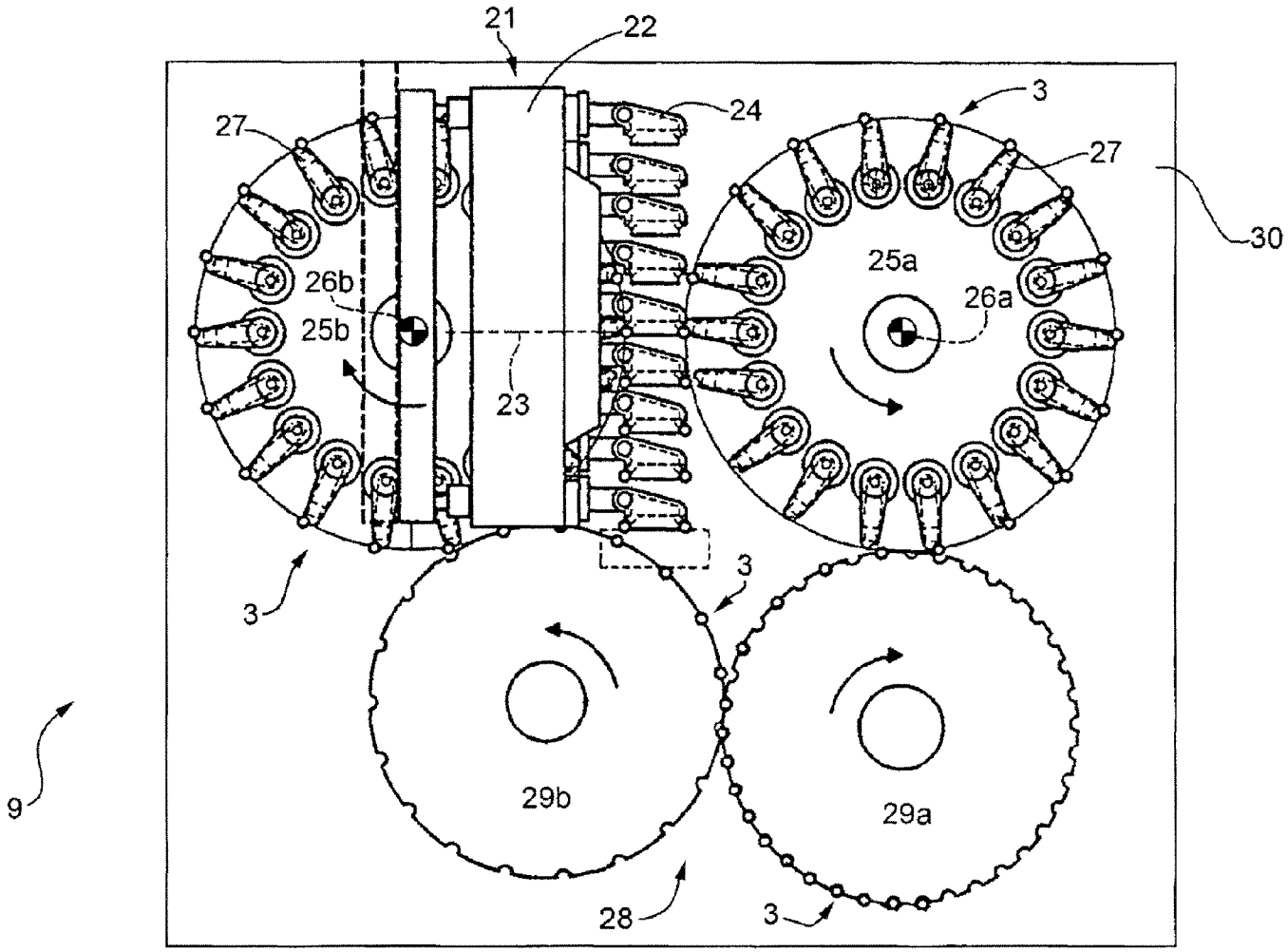
FIG. 3 shows a front view of a transfer unit of the FIG. 1 manufacturing machine.

The movement, in vertical travel direction 33, of spider 21 and the two release drums 25 (together with the two dividing drums 29 of divider 28) to adjust the distance between axis of rotation 23 of drum 22 of spider 21 and forming beam 20 of winding unit 7 is small and normally no more than a few millimeters (e.g. 5-7 mm). In a preferred embodiment, the travel of spider 21 and the two release drums 25 (together with the two dividing drums 29 of divider 28) in vertical travel direction 33 is much greater than required to adjust the distance between axis of rotation 23 of drum 22 of spider 21 and forming beam 20 of winding unit 7, so as to allow spider 21 and the two release drums 25 (together with the two dividing drums 29 of divider 28) to move between a work position (shown by the continuous line in FIG. 3), in which spider 21 is adjacent and connected to forming beam 20 of winding unit 7, and an insertion position, in which spider 21 is detached a good distance from forming beam 20 of winding unit 7 to permit manual insertion of strip 8 of wrapping material inside forming beam 20. That is, in the event of strip 8 of wrapping material tearing, the operator must insert strip 8 of wrapping material manually into forming beam 20. So, to make this easier, spider 21 (together with the two release drums 25 and the two dividing drums 29 of divider 28) is moved in vertical travel direction 33 into the insertion position to make enough room between spider 21 and forming beam 20 to manually insert strip 8 of wrapping material easily into forming beam 20.

Spider 21 and release drum 25 (together with the two dividing drums 29 of divider 28) preferably move together in vertical travel direction 33. For which purpose, spider 21 and the support of movable frame 30 may be carried by the same slide, which is mounted on runners integral with frame 10 to move in vertical travel direction 33 with respect to frame 10.

By way of example, the travel, in vertical travel direction 33, of spider 21 from the work position to the insertion position is a few tens of millimeters (e.g. 40-60 mm).

It is important to note that the movements of spider 21 in travel direction 33, and the movements of movable frame 30, supporting the two release drums 25 and the two dividing drums 29 of divider 28, in travel direction 33, in travel direction 31, and about axis of rotation 32, may be imparted manually by an operator, or by respective electric or pneumatic actuators.

Transfer unit 9 of manufacturing machine 1 as described above is cheap and easy to implement, by having no particularly complicated design features as compared with known transfer units, and above all makes brand changing much faster and easier. This is achieved by making the two release drums 25 movable into the maintenance position, in which the two release drums 25 (particularly release drum 25*b*) are detached a good distance from spider 21. By moving the two release drums 25 into the maintenance position, adjusting/changing mechanical parts in spider 21, and above all in release drums 25, is therefore made faster and easier by the distance between spider 21 and the two release drum 25 (and particularly between spider 21 and release drum 25*b*) affording much greater access.

Moreover, spider 21 and release drums 25 being movable vertically, the distance between axis of rotation 23 of drum 22 of spider 21 and forming beam 20 of winding unit 7 can be adjusted quickly and easily as a function of the size of groups 3 of filter portions 4.

Finally, spider 21 and release drums 25 being movable vertically, spider 21 can be moved away from forming beam 20 of winding unit 7 (into the insertion position) to permit easy manual insertion of strip 8 of wrapping material into forming beam 20.

The invention claimed is:

1. A manufacturing machine (1) for producing combination filters (2) for cigarettes, and comprising:

a group-forming unit (6) for forming groups (3) of filter portions (4), each comprising at least two different filter portions (4) aligned axially and contacting at the ends;

a winding unit (7) which receives a succession of groups (3) of filter portions (4) from the group-forming unit (6), winds a strip (8) of wrapping material about the succession of groups (3) of filter portions (4) to form a continuous filter rod, and cuts the combination filters (2) off the continuous filter rod by cyclically cutting the continuous filter rod transversely; and a transfer unit (9) which transfers the groups (3) of filter portions (4) from the group-forming unit (6), in which the groups (3) of filter portions (4) travel transversely, to the winding unit (7), in which the groups (3) of filter portions (4) travel axially, and comprises at least one spider (21), which feeds the groups (3) of filter portions (4) successively into a forming beam (20) of the winding unit (7) by changing the travel of the groups (3) of filter portions (4) from a transverse travel to an axial travel, and at least one release drum (25) which releases the groups (3) of filter portions (4) successively directly to the spider (21);

wherein the release drum (25) is mounted to rotate about a first axis of rotation between a work position, in which the release drum (25) is adjacent and connected to the spider (21), into a maintenance position, in which the release drum (25) is detached a good distance from the spider (21), the first axis of rotation being different than a second axis of rotation about which the release drum rotates in the work position and the first axis of rotation being disposed in a plane intersected by the second axis.

2. A manufacturing machine (1) as claimed in claim 1, wherein the release drum (25) is mounted to slide, in a first travel direction (31), between the work position and an intermediate position; and the release drum (25) is mounted to rotate about the first axis (32) of rotation between the intermediate position and the maintenance position.

3. A manufacturing machine (1) as claimed in claim 2, wherein the first axis (32) of rotation is vertical and perpendicular to a horizontal second axis (26) of rotation of the release drum (25), and the first travel direction (31) is horizontal and parallel to the horizontal second axis (26) of rotation of the release drum (25).

4. A manufacturing machine (1) as claimed in claim 1, wherein the transfer unit (9) comprises:

two side by side, parallel release drums (25), each of which transfers respective groups (3) of filter portions (4) to the spider (21); and a divider (28) which divides a single stream of groups (3) of filter portions (4) from the group-forming unit (6) into two symmetrical streams of groups (3) of filter portions (4), which are fed to the two release drums (25).

5. A manufacturing machine (1) as claimed in claim 4, wherein the two release drums (25) and the divider (28) are fitted to the same frame (30), which is mounted to move between the work position and the maintenance position.

6. A manufacturing machine (1) as claimed in claim 4, wherein the divider (28) comprises:

a first dividing drum (29*a*) which receives a single stream of filter portions (4) from the group-forming unit (6), and feeds a first stream of filter portions (4) to a first release drum (25*a*) located over the first dividing drum (29*a*); and a second dividing drum (29*b*) which receives a second stream of filter portions (4) from the first dividing drum (29*a*), and feeds the second stream of filter portions (4) to a second release drum (25*b*) located over the second dividing drum (29*b*).

7. A manufacturing machine (1) as claimed in claim 1, wherein the spider (21) and the release drum (25) are mounted to move in a vertical second travel direction (33) to adjust the distance between a third axis (23) of rotation of the spider (21) and the forming beam (20) of the winding unit (7) as a function of the size of the groups (3) of filter portions (4).

8. A manufacturing machine (1) as claimed in claim 1, wherein the spider (21) is mounted to move, in a vertical second travel direction (33), between a work position, in which the spider (21) is adjacent and connected to the forming beam (20) of the winding unit (7), and an insertion position, in which the spider (21) is detached a good distance from the forming beam (20) of the winding unit (7) to permit manual insertion of a strip (8) of wrapping material inside the forming beam (20).

9. A manufacturing machine (1) as claimed in claim 8, wherein the release drum (25) is also mounted to move, in the vertical second travel direction (33), between the work position, in which the spider (21) is adjacent and connected to the forming beam (20) of the winding unit (7), and the insertion position, in which the spider (21) is detached a good distance from the forming beam (20) of the winding unit (7) to permit manual insertion of a strip (8) of wrapping material inside the forming beam (20).

10. A manufacturing machine (1) as claimed in claim 1, wherein the group-forming unit (6) is perpendicular to the winding unit (7).

11. A manufacturing machine (1) as claimed in claim 1, wherein the spider (21) comprises a spider drum (22) that rotates continuously about a horizontal third axis of rotation (23) and supports a number of peripheral assemblies (24), each of which support a suction gripping head and is fitted to the spider drum (22) to rotate, as the spider drum (22) rotates, about a respective axis of rotation parallel to the third axis of rotation (23) of the spider drum (22), so as to remain horizontal and parallel to itself at all times.

12. A manufacturing machine (1) as claimed in claim 11, wherein each assembly (24) supports a suction gripping head having two parallel suction seats.

13. A manufacturing machine (1) as claimed in claim 11, wherein the release drum (25) has radial arms (27) mounted to rotate about axes of rotation parallel to the second axis of rotation (26) of the release drum (25), and having respective suction seats on the end for housing groups (3) of filter portions (4).

14. A manufacturing machine (1) as claimed in claim 13, wherein the second axis of rotation (26) of the release drum (25) is perpendicular to the horizontal axis of rotation (23) of the spider drum (22).

15. A manufacturing machine (1) as claimed in claim 1, wherein:

the release drum (25) rotates about the second axis of rotation (26);

the spider (21) comprises a spider drum (22) that rotates continuously about a horizontal third axis of rotation (23); and the second axis of rotation (26) of the release drum (25) is perpendicular to the horizontal third axis of rotation (23) of the spider drum (22).

16. A manufacturing machine (1) for producing combination filters for cigarettes, and comprising:

a group-forming unit (6) for forming groups (3) of filter portions (4), each comprising at least two different filter portions (4) aligned axially and contacting at the ends;

a winding unit (7) which receives a succession of groups (3) of filter portions (4) from the group-forming unit (6), winds a strip (8) of wrapping material about the succession of groups (3) of filter portions (4) to form a continuous filter rod, and cuts the individual groups (3) of filter portions (4) off the continuous filter rod by cyclically cutting the continuous filter rod transversely; and a transfer unit (9) which transfers the groups (3) of filter portions (4) from the group-forming unit (6), in which the groups (3) of filter portions (4) travel transversely, to the winding unit (7), in which the groups (3) of filter portions (4) travel axially, and comprises at least one spider (21), which feeds the groups (3) of filter portions (4) successively into a forming beam (20) of the winding unit (7) by changing the travel of the groups (3) of filter portions (4) from a transverse travel to an axial travel, and at least one release drum (25) which releases the groups (3) of filter portions (4) successively directly to the spider (21);

wherein the spider (21) and the release drum (25) are mounted to slide together and by the same amount in a vertical travel direction to adjust the distance between the axis (23) of rotation of the spider (21) and the forming beam (20) of the winding unit (7) as a function of the size of the groups (3) of filter portions (4).

* * * * *